US008013755B2

(12) United States Patent
Rock et al.

(10) Patent No.: US 8,013,755 B2
(45) Date of Patent: Sep. 6, 2011

(54) SYSTEM AND METHODS FOR PROVIDING MASS NOTIFICATION USING EXISTING FIRE SYSTEM

(75) Inventors: Dennis Ted Rock, Pittsfield, ME (US); Steven Hein, Bradenton, FL (US); Munro Howard Sykes, Bradenton, FL (US); Gary Pollack, Gilbert, AZ (US)

(73) Assignee: UTC Fire & Security Americas Corporation, Inc., Bradenton, FL (US)

( * ) Notice: Subject to any disclaimer, the term of this patent is extended or adjusted under 35 U.S.C. 154(b) by 142 days.

(21) Appl. No.: 11/857,624

(22) Filed: Sep. 19, 2007

(65) Prior Publication Data

US 2009/0072989 A1 Mar. 19, 2009

(51) Int. Cl.
*G08B 5/22* (2006.01)

(52) U.S. Cl. ..... 340/815.45; 340/286.05; 340/589

(58) Field of Classification Search ..... 340/815.45, 340/286.05, 505, 825.06, 506, 511, 508, 340/512, 513, 514, 588, 589
See application file for complete search history.

(56) References Cited

U.S. PATENT DOCUMENTS

| | | | | | |
|---|---|---|---|---|---|
| 5,579,443 | A * | 11/1996 | Tatematsu et al. | ..... | 455/521 |
| 5,621,379 | A * | 4/1997 | Collins | ..... | 340/332 |
| 5,650,762 | A * | 7/1997 | Takahashi et al. | ..... | 340/286.05 |
| 5,696,487 | A * | 12/1997 | Choi | ..... | 340/532 |
| 5,769,532 | A | 6/1998 | Sasaki | | |
| 6,291,974 | B1 * | 9/2001 | Matsuo | ..... | 320/166 |
| 6,480,578 | B1 * | 11/2002 | Allport | ..... | 379/48 |
| RE38,183 | E | 7/2003 | Kosich et al. | | |
| 7,519,165 | B1 * | 4/2009 | Rodkey et al. | ..... | 379/88.12 |
| 2006/0038691 | A1 * | 2/2006 | Bard | ..... | 340/628 |
| 2006/0049956 | A1 | 3/2006 | Taylor et al. | | |
| 2006/0087421 | A1 | 4/2006 | Stewart et al. | | |
| 2006/0274542 | A1 * | 12/2006 | Goulet et al. | ..... | 362/490 |
| 2007/0035255 | A1 | 2/2007 | Shuster et al. | | |
| 2007/0290870 | A1 * | 12/2007 | Normand | ..... | 340/632 |
| 2009/0059602 | A1 * | 3/2009 | Santos et al. | ..... | 362/351 |
| 2009/0194670 | A1 * | 8/2009 | Rains et al. | ..... | 250/205 |

OTHER PUBLICATIONS

Arora, Rajeev K, P.E., "Sound the Alarm! Integrating Mass Notification Systems in Airports," Airport Counsulting, Summer 2006, pp. 4-5, (www.ACConline.org).
"Unified Facilities Criteria (UFC); Design and O&M: Mass Notification Systems," UFC 4-021-01; Dec. 2002.
European Search Report issued in connection with corresponding EP Patent Application No. 08164197.9 on Jan. 15, 2009.
Office Action received in EP 08164197, dated Aug. 17, 2010, 9 pages.

* cited by examiner

*Primary Examiner* — Daniel Previl
(74) *Attorney, Agent, or Firm* — Kinney & Lange, P.A.

(57) ABSTRACT

An apparatus configured to integrate with existing fire system strobe/horn plates. The apparatus may be a mass notification plate. Also disclosed are embodiments of a strobe housing configured to mix and/or reflect light emitted from one or more light emitters, such as high intensity LEDs, through a lens. The lens may be configured to produce a mass notification pattern. Further disclosed are embodiments of systems and methods that may be configured to deliver strobe control signals and/or strobe color control signals over a two-wire fire system powerline.

11 Claims, 8 Drawing Sheets

SYSTEM AND METHODS FOR PROVIDING MASS NOTIFICATION USING EXISTING FIRE SYSTEM

BACKGROUND

1. Field of the Invention

The field of the invention relates to fire detection systems generally, and more particularly to certain new and useful advances in improving fire detection systems to include mass notification capability of which the following is a specification, reference being had to the drawings accompanying and forming a part of the same.

2. Discussion of Related Art

In recent years, the field of mass notification has developed in response to the threat of terrorist attacks on civilian and government facilities, the threat of violence on school and university campuses, the danger afforded by natural and/or man-made hazards, and other events that require the emergency management of a large group of people.

Regardless of the type of emergency, authorities must be able to communicate quickly and clearly with all people who are or may be affected by the emergency. A mass notification system provides this capability and permits real-time information to be disseminated to all people in the immediate vicinity of a building or larger geographic area during and after an emergency using graphical information, textual information, visible signaling, audible signaling, intelligible voice communications, and the like. When properly designed and implemented, a mass notification system can save lives.

In the United States, the field of mass notification is addressed/regulated by entities that include but not limited to, the Department of Defense (DoD), the Occupational Health and Safety Administration (OSHA), the National Fire Protection Association (NFPA), and the Federal Emergency Management Agency's (FEMA). For example, OSHA 1910.165 requires employers that use an alarm system to provide warning for necessary emergency action as called in the emergency action plan or reaction time for safe escape of employees from the work place, the immediate work area, or both. As another example, Annex E of the National Fire Protection Association (NFPA) 72 provides requirements for the application, installation, location, performance and maintenance of a mass notification system ("MNS"). As yet another example, the Federal Emergency Management Agency's (FEMA) Outdoor Public Alerting System Guide (December 2004) advocates, "using voice technology to address all natural and man-made hazards, including acts of terrorism and requires that all warning systems be operable in the absence of AC supply power."

FIG. 1 schematically illustrates the inputs 100, interfaces 120, and proposed mass notification outputs 130 of an existing fire system 121, alarm inputs 101, 102, 103, public address system 122, and Flight Information Display System (FIDS) 123 of a typical airport. Alarm input 101 may be a traditional fire alarm input. Alarm input 102 may be an automated emergency alarm input (non-fire). Alarm input 103 may be a manually activated emergency alarm (non fire) issued by a command center 104 to either a roadway signage system 105 or to a ground control operation 106. Output 131 includes activation of fire alarm strobes. Proposed mass notification output 133 includes activation of amber emergency strobes. Proposed mass notification output 134 includes activation of public address system. Proposed mass notification output 135 includes activation of a Flight Information Display System in a visual paging emergency textual information mode.

As FIG. 1 illustrates, disparate fire, public address, and flight information systems 121, 122, 123 that are separately installed do not form an integrated mass notification system. One reason for this is that the existing fire system 121 uses clear strobes at output 131 to indicate visually that a fire alarm has been activated, whereas standards such as NFPA 72-2007 require a mass notification system to use an amber strobe at output 133 to indicate all other types of emergencies. Other reasons are that each system 121, 122, 123 has different power requirements and uses different device communication protocols.

Thus, many unsolved challenges remain before an integrated mass notification system can be developed. Some include, but are not limited to: determining what existing systems (if any) should be used and/or integrated to form a mass notification system; determining what data protocols should be used to communicate emergency information among different types of mass notification technologies; determining the details of how to retrofit and/or modify existing fire systems to provide mass notification capabilities and/or to interface with non-fire systems while still meeting the strict fire system design and operating standards; determining the details of how to add amber emergency strobe capability to existing fire systems using the existing fire system wiring and/or a single integrated fire system/mass notification control circuit; and the like.

A need therefore exists for systems, methods and apparatus configured to integrate mass notification capability, including amber strobes, to an existing fire system in a manner that is cost-effective and that potentially eliminates the need to add stand-alone wiring and a stand-alone mass notification control circuit to an existing fire system.

SUMMARY

The present disclosure provides economical solutions to at least the problems mentioned above, as well as other advantages.

In this document, the term "strobe" refers to a light emitter, such as an LED, an LED array, or a flash bulb, that is configured to flash on and off repeatedly when activated. In like manner, the term "strobe housing" refers to a clear, colored, and/or reflective material (and combinations thereof) that fully or partially encloses a light emitter.

In this document, embodiments of a mass notification plate configured to integrate with existing fire system strobe/horn plates are disclosed. Also disclosed are embodiments of a strobe housing configured to mix and reflect light emitted from one or more high intensity LEDs through a lens that may be configured to produce a mass notification pattern on a wall and/or a ceiling. Further disclosed are embodiments of systems that may be configured to deliver strobe control signals and/or strobe color control signals over a two-wire fire system powerline. Also disclosed are embodiment of methods of receiving control signals over the two-wire fire system powerline and for decoding and applying the control signals to one or more LEDs to comply with one or more mass notification optical requirements. Also disclosed is an embodiment of a method for driving two strobes, a fire system strobe and a mass notification strobe, with strobe activation controlled remotely over the two-wire fire system powerline so that only one of the strobes activates at a time. Also disclosed is an embodiment of an individual strobe having a switch that designates the strobe as either a mass notification strobe or as a fire system strobe. Further disclosed is an embodiment of a method of decoding control signals received over a two wire fire system powerline and applying the decoded control signals as strobe "on" or strobe "off" commands to mass notification strobes and fire system strobes that are each coupled to the two powerline wires.

Embodiments of the invention implemented via computer afford one or more technical effects, examples of which may include, but are not limited to: decoding a control signal and outputting an indication of a type of alarm (fire or mass notification) that the control signal represents; activating a fire strobe in response to a decoded control signal; activating a mass notification strobe in response to a decoded control signal; outputting a strobe "on" command; outputting a strobe "off" command; mixing two or more colors of light in an optical chamber to produce mixed light having a mass notification color and/or a mass notification pattern.

Some advantages and/or technical effects afforded by embodiments of the invention described herein include, but are not limited to:

- an ability to select a desired strobe color as a mixture of light from LEDs generating primary colors;
- an ability to select the above color either locally on each unit or remotely over two power leads;
- an ability to individually select a strobe's signal function for either fire signaling or mass notification signaling;
- an ability to remotely control the actuation of either fire strobes or mass notification strobes independently with both types of strobes receiving power from the same loop having only two leads;
- an ability to use control signals that are presently used for "horn on/off" control determination and interpret these signals instead as mass an ability to provide charging from a single circuit to either of two strobe flash capacitors and flash tubes, that have functions defined as fire and mass notification signaling;
- an ability to remotely select whether strobes intended for fire or intended for mass notification are enabled, wherein this selection can be performed over the same two power leads that are connected to both fire and mass notification strobes.

Other features and advantages of the disclosure will become apparent by reference to the following description taken in connection with the accompanying drawings.

BRIEF DESCRIPTION OF THE DRAWINGS

For a more complete understanding of the various embodiments of the invention described herein, and the advantages thereof, reference is now made to the following descriptions taken in conjunction with the accompanying drawings, in which.

Like reference characters designate identical or corresponding components and units throughout the several views.

DETAILED DESCRIPTION

Figure 2:
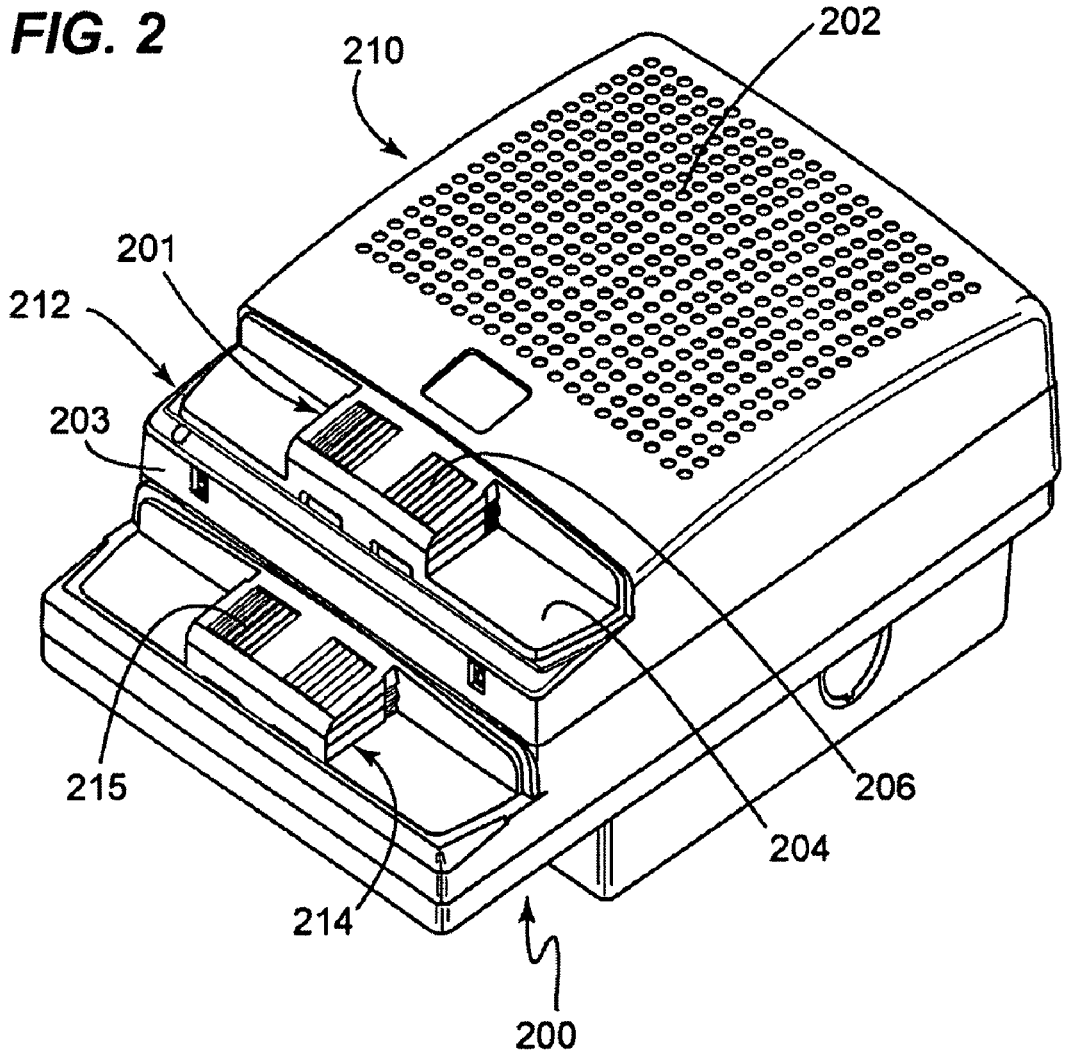
FIG. 2 is an isometric view of an embodiment of a mass notification plate combined with an existing fire system strobe/horn plate.

FIG. 2 is an isometric view of an embodiment of a mass notification plate 200 that may be added to an existing fire system strobe/speaker or strobe/horn plate 210. Referring to FIG. 2, an existing fire system strobe/horn plate 210 may have four walls enclosed by top and bottom substrates. A top substrate 205 of the existing fire system strobe/horn plate 210 may be perforated 202 to permit sound produced by a speaker (not shown) positioned under the perforations 202 to emit from the fire system strobe/horn plate 210 when a fire alarm is activated. One end 212 of the fire system strobe/horn plate 210 may include a compartment 203. The compartment 203 may house circuitry and/or a computer processor and/or computer readable memory that are configured to operate the fire system strobe 201 and the fire system horn. The fire system strobe 201 may be a light emitter (not shown) contained within a clear strobe housing 206, which may be positioned on a top surface 204 of the compartment 203. In an embodiment, the light emitter may be a conventional white flash bulb. Alternatively, the light emitter may be one or more LED's.

Figure 3:
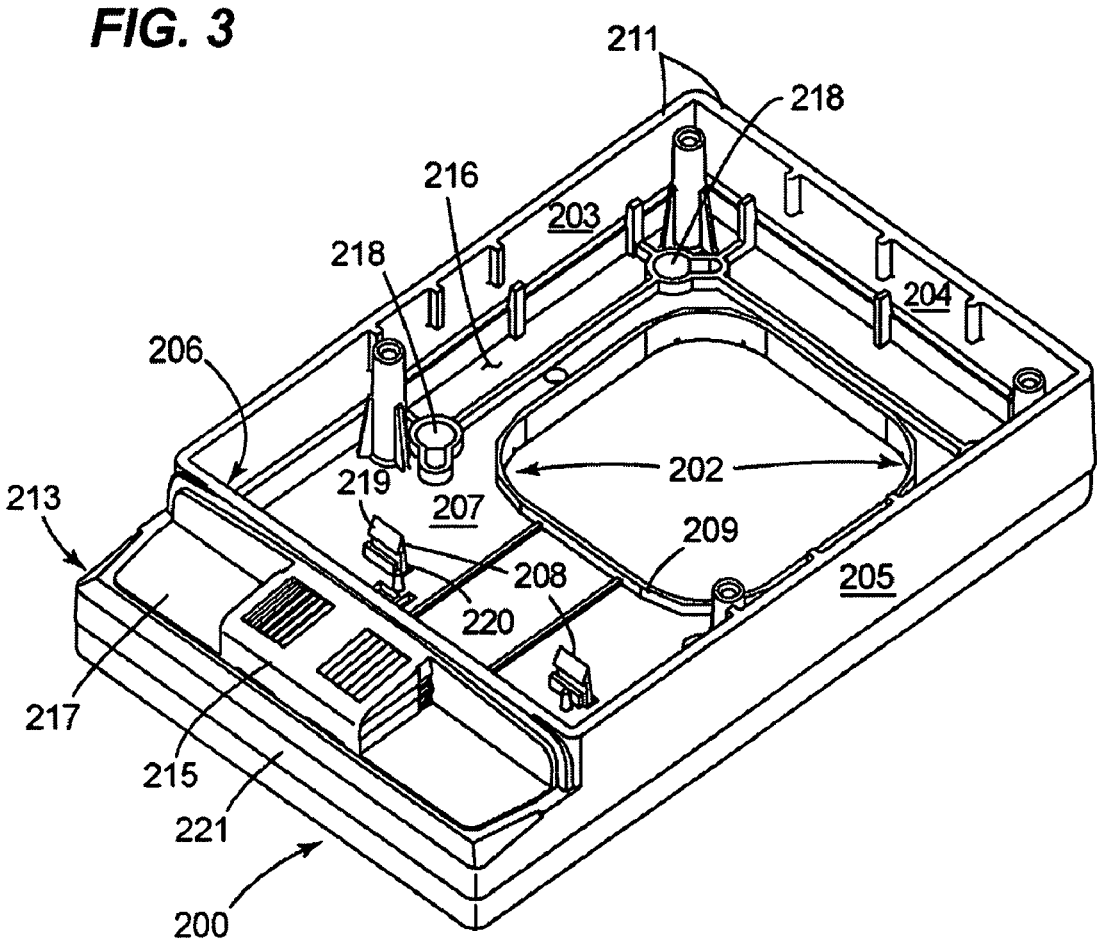
FIG. 3 is an isometric view an embodiment of the mass notification plate of FIG. 2.

FIG. 3 is an isometric view an embodiment of the mass notification plate 200 of FIG. 2, with the existing fire system strobe/horn plate 210 decoupled from a top surface 211 and/or a chamber 216 of the mass notification plate 200.

Referring to FIGS. 2 and 3, the mass notification plate 200 may have at least walls 203, 204, 205, and 206. The walls 203, 204, 205, and 206 may couple with a substrate 207 to form the chamber 216. As will be further explained below, a portion of the mass notification plate 200 may be configured to couple detachably with an existing fire system strobe/horn plate 210. Additionally, an electrical or digital component of the mass notification plate 200 may be configured to integrate with and/or to operate an electrical or digital component of the fire system strobe/horn plate 210.

An end 213 of the mass notification plate 200 may include a compartment 221. The compartment 221 may house circuitry and/or a computer processor and/or computer readable memory that are configured to operate the mass notification strobe 214 and the fire system horn.

In an embodiment, the substrate 207 is a bottom substrate of the mass notification plate 200, and may also form part of the compartment 221 formed at an end 213 of the mass notification plate 200. The substrate 207 may include an opening 202 formed therein. The opening 202 may include a rim 209. The opening 202 may be sized and positioned in the substrate 207 to permit one or more wires from a fire system junction box (not shown) to couple with a corresponding one or more wires coupled with an electrical and/or digital component of the mass notification plate 200 and/or an electrical and/or digital component of the fire system strobe/horn plate 210.

One or more fastener openings 218 may be formed in predetermined areas of the substrate 207. Fasteners (not shown), may be inserted through the fastener openings 218 to secure the mass notification plate 200 to an existing fire system junction box (not shown). The fasteners may include, but are not limited to screws.

One or more connectors 208 formed on a surface of the substrate 207 may be configured to couple detachably with a circuit board containing optical and electrical components for strobe, strobe/horn and/or strobe/speaker operation.

The mass notification strobe 214 may be a light emitter (not shown) contained within a mass notification strobe housing 215, which may be positioned on a top surface 217 of the compartment 221. In an embodiment, the light emitter may be a white mass notification flash bulb (not shown) contained within an amber-colored or other-colored mass notification strobe housing 215. The light emitter, either white or amber, may be coupled with a controller, a switch, and/or a driver configured to energize the light emitter to produce light in response to a mass notification event.

Figure 4:
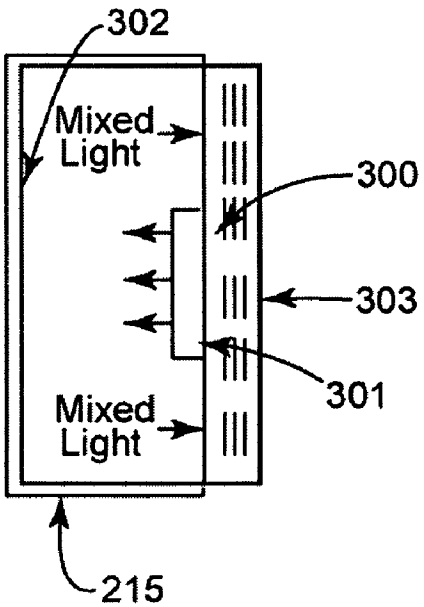
FIG. 4 is a diagram illustrating an embodiment of a light emitter configured as a high intensity LED array.

Another embodiment of the mass notification strobe 214 is shown in FIG. 4, which is a diagram illustrating a light emitter 300 configured as a high intensity LED array 301. The LED array 301 may include a single color-variable LED (not shown) contained within the mass notification strobe housing 215, which may optionally include a reflective surface 302 and a lens 303. The lens 303 may be configured to produce a mass notification pattern An example of a single color-variab1e LED is one high-intensity combined Red, Green, Blue (RGB) LED.

In another embodiment, the light emitter 300 may be a LED array 301 of high intensity colored LEDs (not shown) contained within a clear mass notification strobe housing 215, which may be configured as a light mixing optical chamber. In such a configuration, the strobe housing 206 and/or the mass notification strobe housing 215 may each include a lens 303 configured to produce a NFPA and UL-required light pattern, and may further include a highly reflective surface 302, that may be diffuse and/or specular. The LED array 301 of colored LEDs may include a high intensity Red LED, a high intensity Blue LED, and a high intensity Green LED. In operation, colored light emitted by the individual RGB LED's mixes within the mass notification strobe housing 215 to form mixed light having a mass notification color, such as but not limited to, amber. The mixed light may reflect from the highly reflective surface 302 and through the lens 303 to form a pattern, either for wall or ceiling use, as defined by UL 1971 or future UL 1638 provisions that will address mass notification applications. The lens 303 may be clear or colored.

The light emitter 300, e.g., LED array 301, may be coupled with a controller, a switch, and or a driver that is configured to drive the LED array 301 to produce colored light in response to a mass notification event.

The mass notification plate 200 and/or the fire system strobe/horn plate 210 may be formed of any suitable material or combination of different materials. Illustratively, the mass notification plate 200 and/or the fire system strobe/horn plate 210 may be formed of an extruded material, a machined material, and/or an injection molded material. Exemplary materials that may be used to form embodiments of the mass notification plate 200 include, but are not limited to, plastic, glass, polymer, metal, metal alloy, combinations thereof, and the like.

Figure 1:
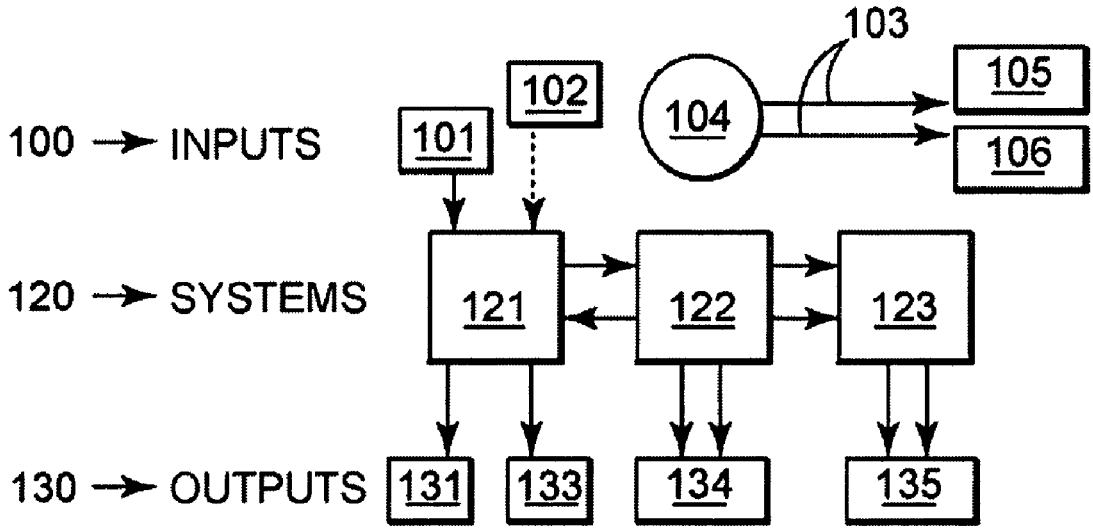
FIG. 1 (Prior Art)
FIG. 1 is a prior art schematic illustrating the existing fire, public address, and flight information display system (FIDS) of a typical airport and the need to integrate these systems to form a complete mass notification system.

Referring to FIGS. 1 and 2, in use, an existing fire system strobe/horn plate 210 may be decoupled from a fire system junction box (not shown). The mass notification plate 200 may then be coupled with the fire system junction box, or proximate thereto. The detached fire system strobe/horn plate 210 may be coupled with the mass notification plate. In an embodiment, the detached fire system strobe/horn plate is positioned over the chamber 216 of the mass notification plate 200. Electrical and/or digital components of the mass notification plate 200 and the fire system strobe/horn plate 210 may be coupled together. Alternatively, electrical and/or digital components of the mass notification plate 200 may be wired, to a fire alarm control panel, separately from electrical and/or digital components of the fire system strobe/horn plate 210. The mass notification plate 200 and the fire system strobe/horn plate 210 may then be urged together and detachably coupled using screws or the like through both plates 200 and 210. When installation is complete, the mass notification plate 200 may be positioned between the fire system junction box and the fire system strobe/horn plate 210.

Figure 5:
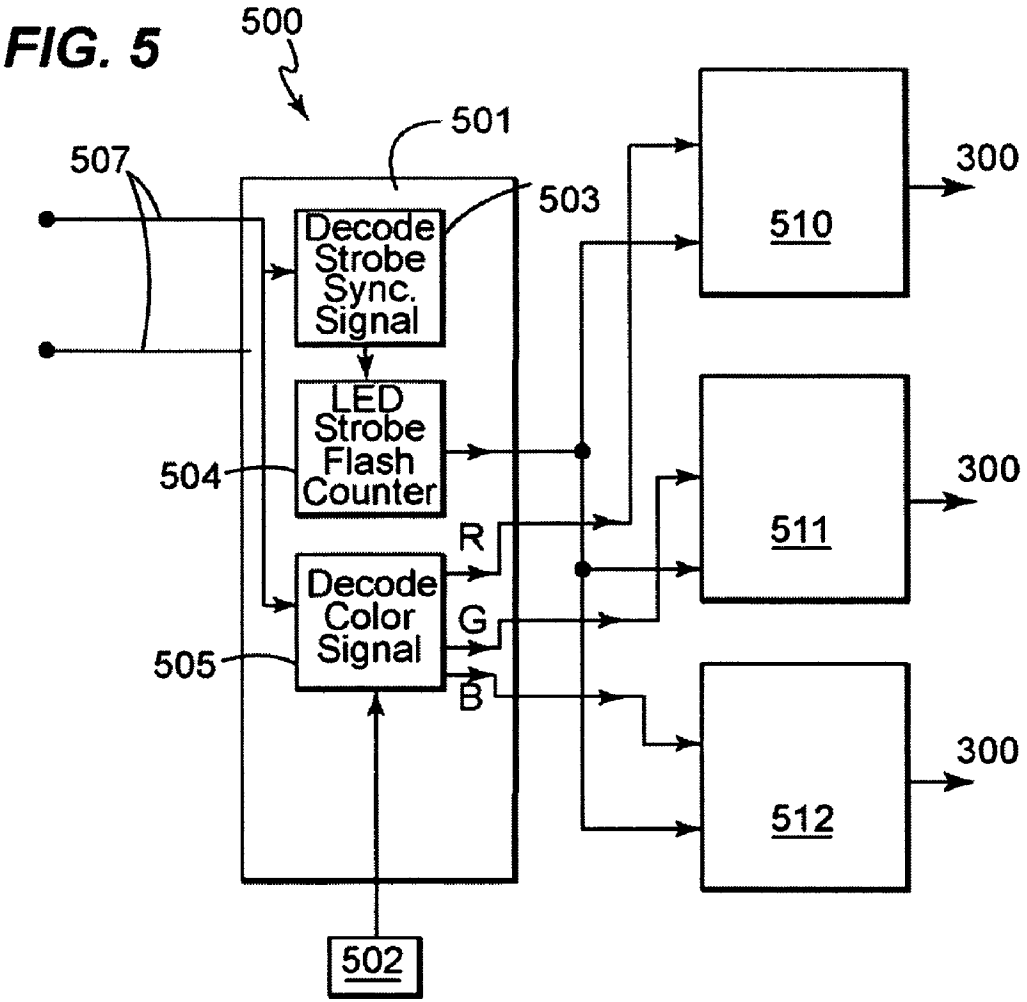
FIGS. 5, 6, and 7 are wiring diagrams illustrating embodiments of systems that may be used to integrate embodiments of the mass notification plate of FIGS. 1 and 2 with existing two-wire fire system powerlines.
Figure 6:
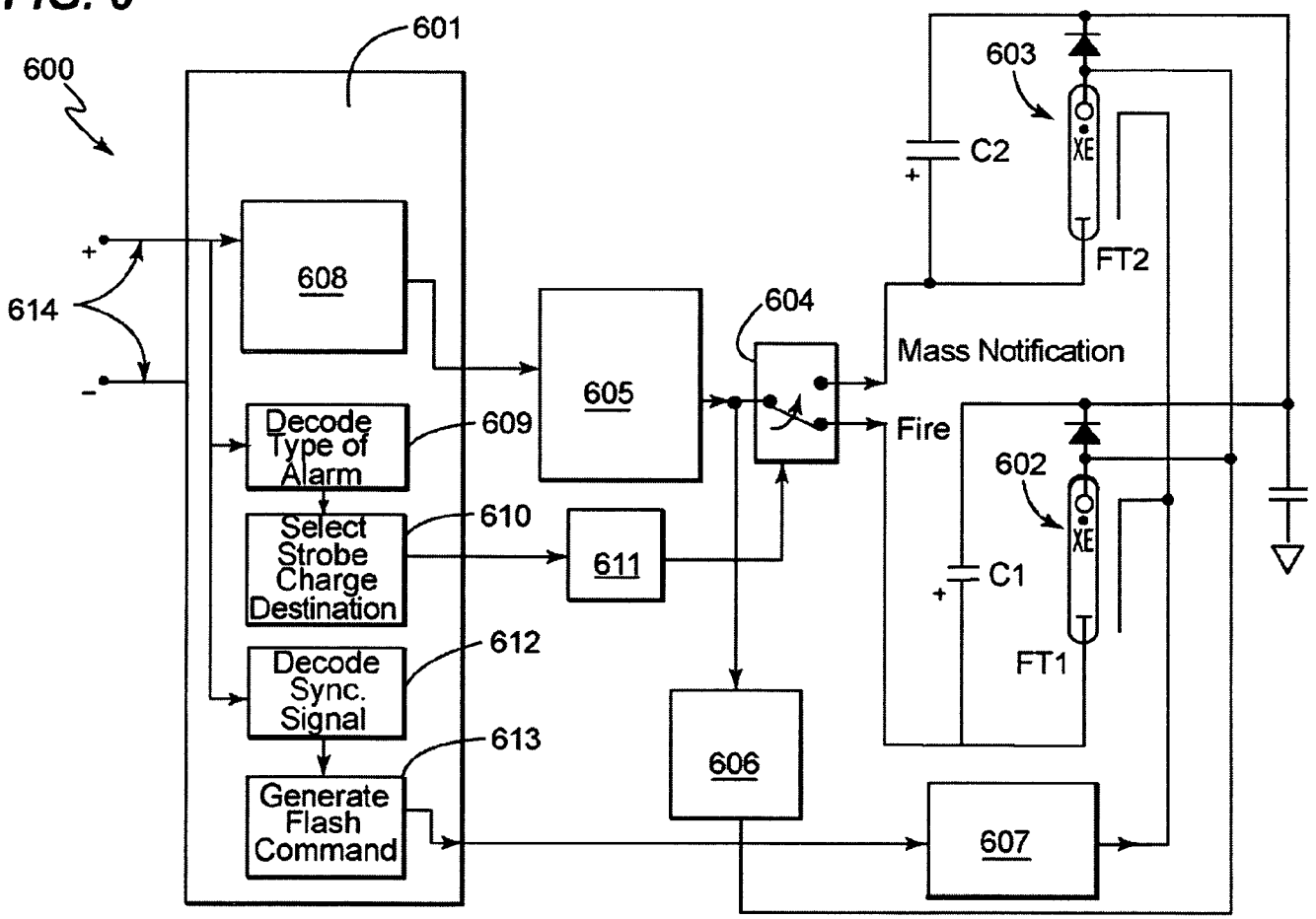
Figure 7:
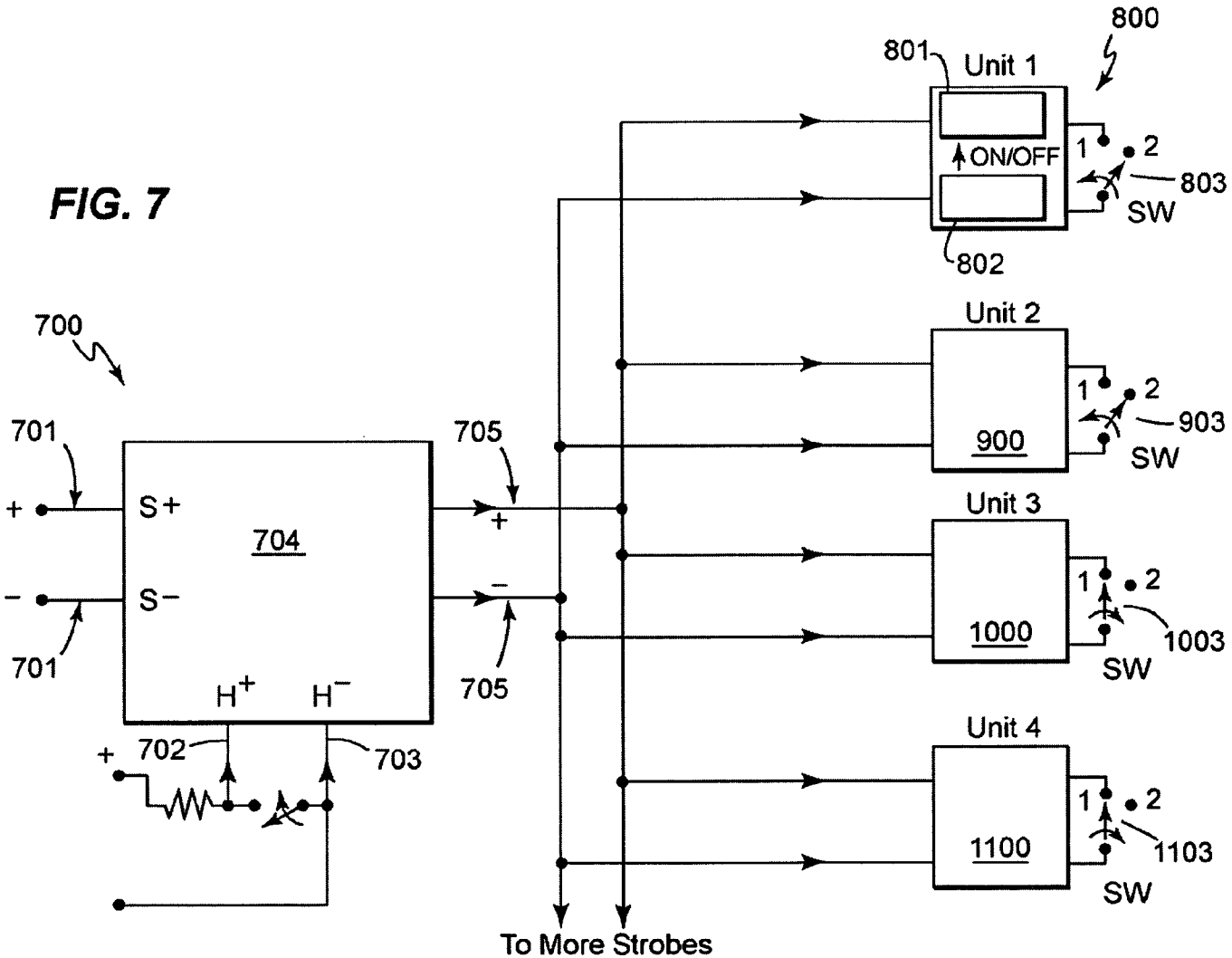

FIGS. 5, 6, and 7 are wiring diagrams illustrating embodiments of systems 500, 600, and 700 that may be used to integrate embodiments of the mass notification plate 200 of FIGS. 1 and 2 with existing two-wire fire system powerlines.

Referring to FIG. 5, an embodiment of a two-wire system 500 may include a microprocessor 501 coupled with a Red LED driver 510, a Green LED driver 511, and a Blue LED driver 512. Each LED driver 510, 511, 512 may be coupled with an embodiment of the high intensity light emitter 300 of FIG. 4.

The microprocessor 501 may include a strobe sync signal decoder 503 configured to output data to a strobe flash controller 504. The microprocessor 501 may further include a color signal decoder 505. Each of the strobe sync signal decoder 503, the strobe flash controller 504, and the microprocessor 501 may be implemented as computer software or as computer firmware. A color select switch 502 may be coupled with the color signal decoder 505. Control signals may be sent over the two-wire fire system powerline 507. The control signals may be received the microprocessor 501, and may include strobe sync control signals, LED flash control signals, and/or LED color signals. Each control signal may be coded as a fire system control signal or as a mass notification control signal. Each of the LED strobe flash controller 504 and the color signal decoder may be configured to output a signal to the Red LED driver 510, the Green LED driver 511, and the Blue LED driver 512.

Referring to FIGS. 1, 2, 4 and 5, an embodiment of the system 500 may be integrated within the compartment 221 of the mass notification plate 200. Another embodiment of the system 500 may be incorporated in a remote fire system control panel and may be configured to transmit control signals remotely over the control two-wire fire system powerline 507. The RGB LED colors are driven by the LED drivers 510, 511, and 512. The amount of LED drive for each of the three colors may be determined in the microprocessor 501 by the color signal decoder 503, which may receive inputs either from a color select switch 502 integrated in the mass notification plate 200 or by signals received from the powerline wire 507. Using outputs from the strobe sync signal decoder 503, the microprocessor 501 may synchronize the strobe function with other strobes on the same power line. Using outputs from the LED strobe flash controller 504, the microprocessor 501 may control the actual LED flashes. In embodiments of system 500 having a light emitter 300 that includes a single color LED, the color signal decoder may be inoperable. For example, the color select switch 502 could be hardwired to one particular color setting.

Referring to FIG. 6, an embodiment of a system 600 for controlling selection and activation of a fire system strobe 602 and a mass notification strobe 603 is disclosed. As further explained below, FIG. 6 may further illustrate an embodiment of a method for driving two strobes, a fire system strobe 602 and a mass notification strobe 603, with strobe activation controlled remotely over the two-wire fire system powerline 614 so that only one of the strobes 602, 603 activates at a time.

The light emitters of both the fire system strobe 602 and the mass notification strobe 603 may be Xenon flash tubes, such as those commonly used in UL listed fire systems. Each flashtube may be located in its own independent strobe housing. Each strobe housing may be configured to optimize light output to satisfy UL and NFPA fire and/or mass notification requirements.

Also in system 600, an independent capacitor C1 may be used to store charge for the fire system strobe 602. In system 600, an independent capacitor C2 may be used to store charge for the mass notification strobe 603. Since only one of the capacitors C1 and C2 can charge at a time, the embodiment of the system 600 shown in FIG. 6 is configured to ensure that only one of the fire system strobe 602 or the mass notification strobe 603 functions at a time.

In an embodiment of the system 600, a switch 604 may be configured to control whether the fire system strobe capacitor C1 or the mass notification strobe capacitor C2 receives a charge generated by the strobe charging circuit 605. The switch 604 may be a relay, or other type of switching mechanism.

In another embodiment, a single capacitor may be configured to switch into one of two light emitters, provided that the switch 604 is configured to handle up to about 50 amps of peak flash current. In another embodiment, a single capacitor and a single strobe may be used. Mass notification or fire system control signals sent over the two-wire fire system powerline may be used to activate the single strobe to flash either a mass notification color or a fire color.

The system 600 may further include a voltage doubling circuit 606 and a flash triggering circuit 607 that are each coupled with the mass notification strobe 603 and the fire system strobe 602.

The system 600 may further include a microprocessor 601, which may be integrated within an embodiment of the mass notification plate 200 of FIGS. 1 and 2. Alternatively, the microprocessor 601 may be located remotely from the mass notification plate 200. An embodiment of the microprocessor 601 may include a charging circuit controller 608 configured to output a signal to the strobe charging circuit 605. The microprocessor 601 may further include an alarm decoder 609, which may be configured to output a signal to a strobe charge destination selector 610. The strobe charge destination selector 610 may be configured to output a signal to a switch control circuit 611. The switch control circuit may be configured to operate the switch 604. The microprocessor 601 may further include a sync signal decoder 621, which may be configured to output a signal to a flash command generator 613. The flash command generator 613 may be configured to output a signal to the flash trigger circuit 607.

In operation, a control signal may be received by the microprocessor 601, either locally or over the two-wire fire system powerline 614. The control signal, which may be one of a mass notification control signal and a fire system control signal, may be decoded by the decoder 609 to determine the type of alarm. Based on data output by the alarm decoder 609, a strobe charge destination may be selected by the strobe charge destination selector 610. The strobe charge destination may be one of the fire system strobe 602 and the mass notification strobe 603. In real time, or in near real time, a sync signal may be decoded by the sync signal decoder 612. Based on data output by the sync signal decoder 612, the flash command generator 613 may output a signal to the flash trigger circuit 607. In turn, the flash trigger circuit 607 may output a signal that causes a charged capacitor C1 or C2 to discharge, thereby activating the selected one of the fire system strobe 602 and mass notification strobe 603.

It should be noted that FIG. 6 provides an example of minimal components necessary to realize a multiple strobe configuration that provides both fire system and mass notification capabilities. Other components that could be included in embodiments of system 600 include an existing fire system horn (not shown), a mass notification speaker (not shown) that is separate and distinct from the existing fire system horn, as well as drivers, controllers, and circuits for implementing the same.

Referring to FIG. 7, an embodiment of a system 700 configured to encode and decode fire system signals and/or mass notification signals received over a two-wire power line is illustratively shown. The embodiment of the system 700 shown in FIG. 7 may be implemented by modifying an embodiment of the mass notification plate 200 of FIGS. 1 and 2 to include a switch and to change the computer-readable code, which is executed by the microprocessor 501,601 of FIGS. 5 and 6.

In an embodiment of the system 700, one or more identically configured individual strobes 800, 900, 1000, 1100 each include an onboard switch 803, 903, 1003, 1103, that designates the strobe as either a mass notification strobe or as a fire system strobe. Each onboard switch 803, 903, 1003, and 1103 may be switchable between a first position, designated SW1, and a second position, SW2. Switch position SW1 may configure a strobe 800, 900, 1000, 1100 as a fire system strobe. Switch position SW2 may configured a strobe 800, 900, 1000, 1100 as a mass notification strobe. As illustratively shown in FIG. 7, strobes 800 and 900 may be mass notification strobes since their switches 803, 903 are each in a mass notification position SW2. As illustratively shown in FIG. 7, strobes 1000 and 1100 may each be fire system strobes since their switches 1003, 1103 are each in a fire system position SW1.

An embodiment of the system 700 may provide one loop having both mass notification strobes and fire strobes all on the same two power wires 701. An existing strobe sync signal encoder 704 may be modified so that commands previously known as "horn on" 702 and "horn off"' 703 are sent from the strobe sync signal encoder 704 to all strobes 800, 900, 1000, 1100, and depending on which way their switches 803, 903, 1003, and 1103 are set, they will either turn on and begin flashing or will ignore the commands. Sending an opposite command activates the strobes that failed to flash in response to the first command. The commands 702, 703 may be controlled for either fire or mass notification by applying voltage or shorting between H+ and H− on the strobe sync signal encoder 704. By way of example, and not limitation, an existing strobe sync signal encoder 704 may be a Model G1M or a Model G1M-RM encoder manufactured by GE Security of Bradenton, Fla. The wires 705 that link the strobe sync signal encoder 704 with the strobes 800, 900, 1000, and 1100 may carry power as well as synchronization, mass notification, and/or fire notification control signals.

By way of example, an embodiment of an individual strobe 800 may include an alarm type decoder 802 coupled with a fire system/mass notification selector switch 803 and coupled with a strobe charging circuit 801. Although not shown, the other strobes 900, 1000, and 1100 may be similarly configured.

Figure 8:
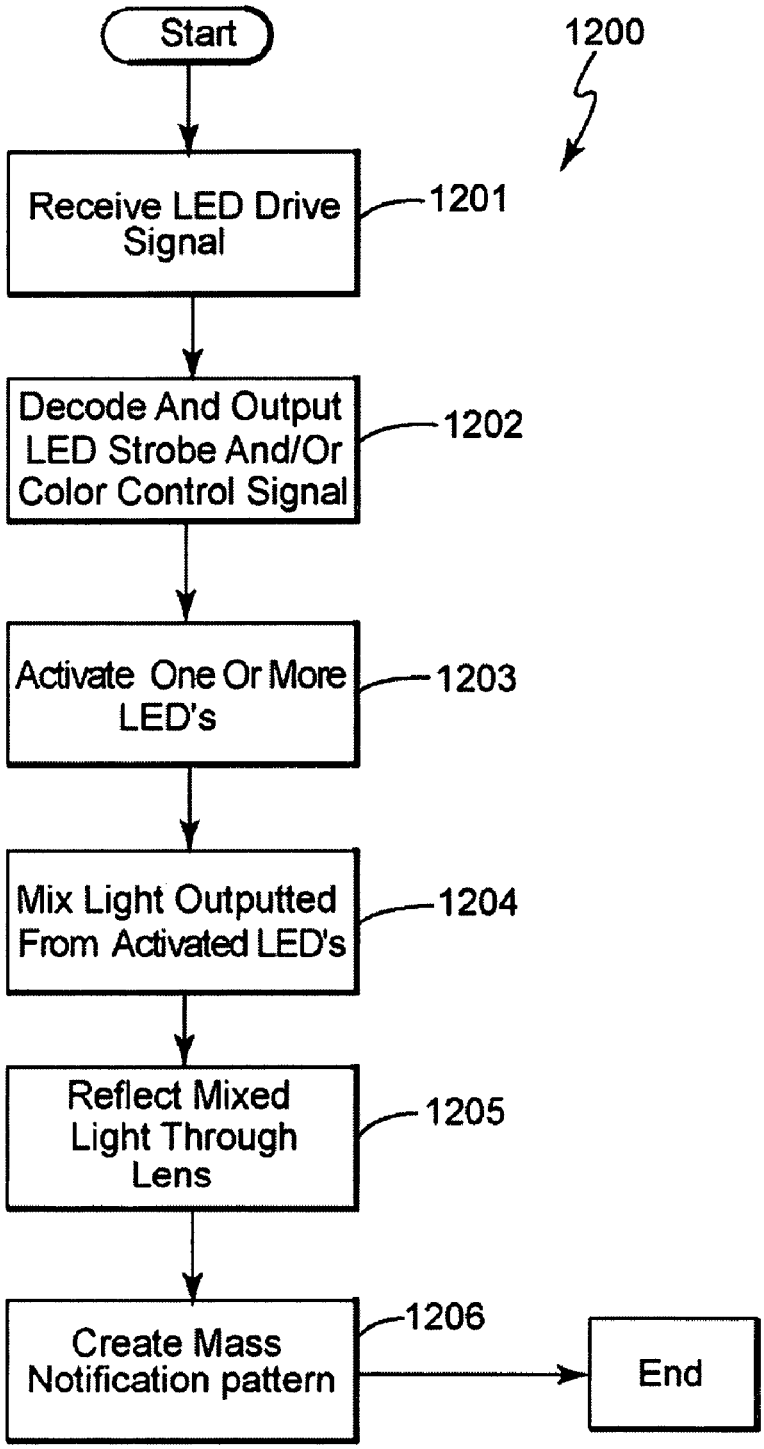
FIGS. 8 and 9 are flowcharts depicting exemplary embodiments of methods that may be practiced by one or more embodiments of the invention.
Figure 9:
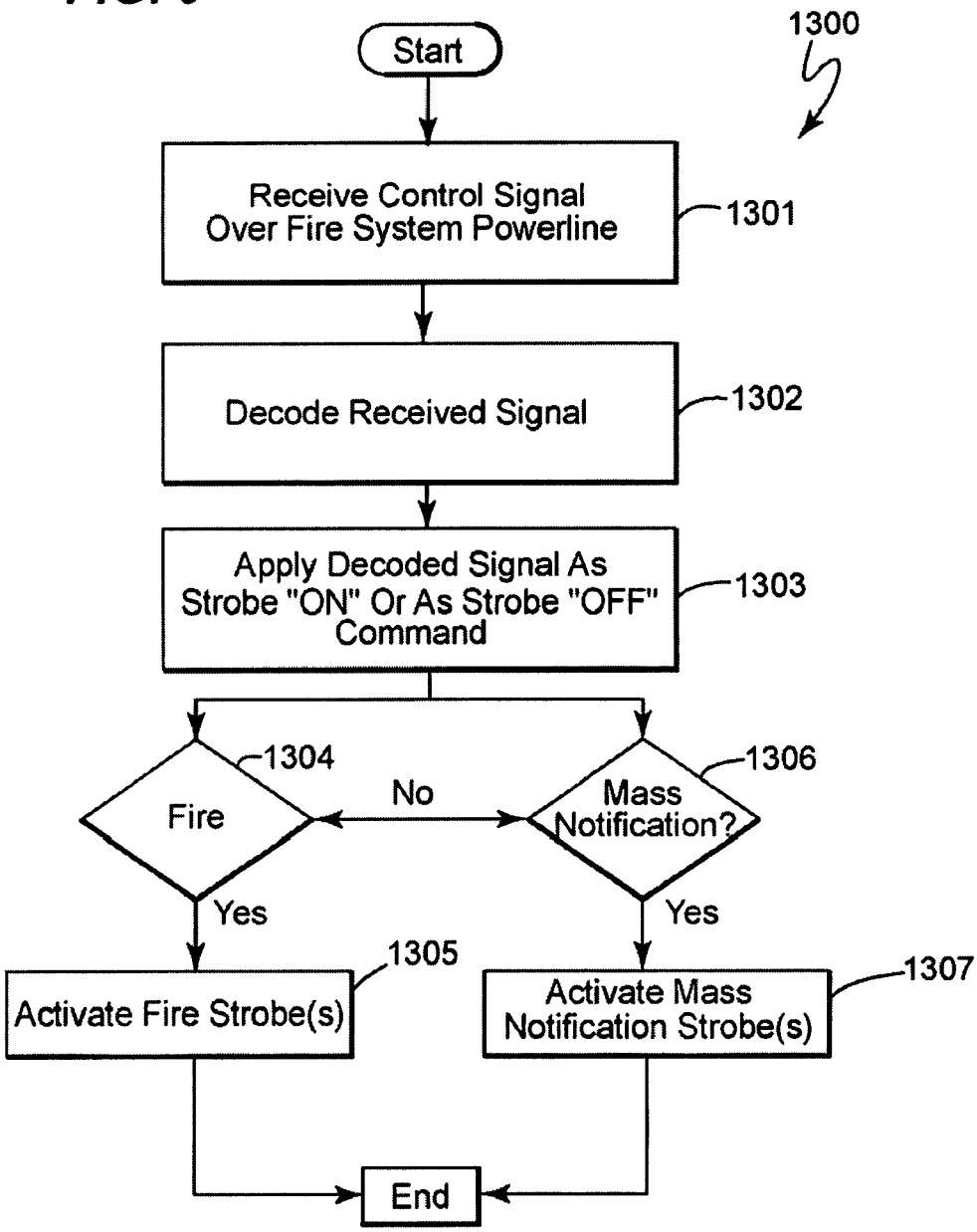

FIGS. 8 and 9 are flowcharts depicting exemplary embodiments of methods 1200, 1300 that may be practiced by one or more embodiments of the invention. Embodiments of the methods illustrated in FIGS. 8 and 9 may be implemented in a computer and associated memory elements within an integrated mass notification and fire system, for example, within an embodiment of the mass notification plate 200. In such an embodiment one or more of the steps of FIGS. 8 and 9 may represent computer program code stored in one or more of the memory elements and executable by the microprocessor. When executed, the computer program code configures the microprocessor to create logical and arithmetic operations to process the flow chart steps. The computer program code may be written in any of the known computer languages and may be embodied in any computer-readable storage medium. When the computer program code is loaded into and executed by a general purpose or a special purpose computer, the computer becomes an apparatus for practicing one or more embodiments of the invention.

Unless otherwise indicated, one or more steps of methods 1200, 1300 may be performed in parallel or in any suitable order.

Referring to FIG. 8, an embodiment of a method 1200 may include a step 1201 of receiving an LED drive signal. The drive signal may be received over a fire system powerline by a computer that forms part of the fire system and/or that forms part of a mass notification system incorporated with the fire system. The method 1200 may further include a step 1202 of decoding and outputting an LED strobe and/or color control signal. The LED strobe control signal and/or the LED color control signal may be outputted to one or more LED drivers. The method 1200 may further include a step 1203 of activating one or more high intensity LEDs. In an embodiment, activating an LED includes at least one of: storing a charge in a capacitor associated with the LED, discharging the capacitor, and emitting strobed light from the LED. The method 1200 may further include a step 1204 of mixing light outputted from the one or more activated LEDs. In an embodiment, the light may be mixed in an optic chamber having a highly reflective surface and a lens. The method 1200 may further include a step 1205 of reflecting the mixed light through the lens, and a step 1206 of creating a mass notification pattern on a wall, floor or ceiling. The display device may be a component of an embodiment of a mass notification plate 200 of FIGS. 1 and 2. After step 1206, the method 1200 may end.

Referring to FIG. 9, an embodiment of a method 1300 may include a step 1301 of receiving a control signal over a fire system powerline. The control signal may be received by a computer that forms part of the fire system and/or that forms part of a mass notification system integrated with the fire system. The method 1300 may further include a step 1302 of decoding the received control signal. In an embodiment, the received control signal may be decoded by a sync signal decoder that forms part of and/or is executed by the computer. The method 1300 may further include a step 1303 of applying the decoded control signal as a strobe "on" command or as a strobe "off" command. The method 1300 may further include a step 1304 of determining whether the decoded control signal is a fire system control signal. If yes, the method 1300 may proceed to the step 1305 of activating one or more fire system strobes. In an embodiment, each fire system strobe includes an LED or flashtube with associated drive circuit having a switch positioned to configure the LED or flashtube drive circuit to activate in response to the fire system control signal. If no, the method 1300 may proceed to a step 1306 of determining whether the decoded control signal is a mass notification control signal. Note that an embodiment of the method 1300 may proceed directly from the step 1303 to the step 1306, and if a "no" is determined at step 1306, may proceed to the step 1304.

At the step 1306, if a "yes" is determined, the method 1300 may proceed to a step 1307 of activating one or more mass notification strobes. In an embodiment, each mass notification strobe includes an LED or flashtube with associated drive circuit having a switch positioned to configure the LED or flashtube drive circuit to activate in response to the mass notification control signal. The method 1300 may end after either of steps 1305 or 1307.

In this document, the terms "decoder," "module," "generator," "controller" and the like, may include computer hardware, software, and/or firmware, unless otherwise noted.

In this document, the term "computer" may include any processor-based or microprocessor-based system that includes systems using microcontrollers, reduced instruction set circuits (RISC), application-specific integrated circuits (ASICs), logic circuits, and any other circuit or processor that is capable of executing the functions described herein. The examples given above are exemplary only, and are not intended to limit in any way the definition and/or meaning of the term 'computer'.

In an embodiment where the invention is implemented using software (a set of instructions embodied in computer program code), the software may be stored in a main memory of the computer and/or in the secondary memory of the computer. The software may include various commands that instruct the microprocessor to perform specific operations, such as the processes of the various embodiments of the invention. The software may be in various forms, such as system software or application software. Further, the software may be in the form of a collection of separate programs, a program module within a larger program, or a portion of a program module. The software may also include modular programming in the form of object-oriented programming.

As used herein, the terms 'software' and 'firmware' are interchangeable and include any computer program that is stored in one or more of memory elements, to be executed by a computer, which includes RAM memory, ROM memory, EPROM memory, EEPROM memory, and non-volatile RAM (NVRAM) memory. The memory types mentioned above are only exemplary and do not limit the types of memory used to store computer programs.

An embodiment of the invention may be implemented primarily in hardware using, for example, hardware components such as application specific integrated circuits (ASICs). Implementation of such a hardware state machine to perform the functions described herein will be apparent to persons skilled in the relevant art(s).

An embodiment of the invention may be implemented using a combination of both hardware and software.

When reading and/or interpreting this document, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

As mentioned above, the foregoing detailed description is by way of illustration and not of limitation. It is intended that embodiments of the invention should be limited only by the appended claims, or their equivalents, in which it has been endeavored to claim broadly all inherent novelty.

What is claimed is:

1. A method of selectively emitting either a strobing white light signaling a fire alarm or a strobing amber light signaling a mass notification, said method comprising:

receiving a control signal over a two-wire fire system powerline;

decoding the received control signal;

selecting one of a fire system strobe and a mass notification strobe based upon the decoded control signal;

if the fire system strobe is selected, and the decoded control signal is a strobe ON command, activating the fire system strobe to emit strobing white light;

if the fire system strobe is selected, and the decoded control signal is a strobe OFF command, deactivating the fire system strobe;

if the mass notification strobe is selected, and the decoded control signal is a strobe ON command, simultaneously activating at least two light emitters positioned in an optical chamber having a highly reflective surface, wherein the activated light emitters each emit a different color of light such that strobing light outputted from the activated light emitters mixes within the optical chamber to produce strobing mixed light having the amber mass notification color, said amber mass notification color being different from the color of light emitted by each of the activated light emitters; and if the mass notification strobe is selected, and the decoded control signal is a strobe OFF command simultaneously deactivating the activated light emitters.

2. The method of claim 1, wherein the light emitters comprise one or more high intensity LEDs.

3. The method of claim 1, further comprising:

reflecting the mixed light having a mass notification color though a lens to create a mass notification pattern.

4. The method of claim 1, wherein the mass notification color is amber.

5. The method of claim 1, wherein the highly reflective surface is one of specular, diffuse and a combination thereof.

6. A system, comprising:

a fire system strobe/horn plate coupled with a two-wire fire system powerline and including a fire alarm strobe for emitting strobing white light;

a mass notification plate coupled with the fire system strobe/horn plate said mass notification plate comprising:

an optical chamber having a highly reflective surface; and a mass notification strobe positioned in the optical chamber for emitting strobing amber light; and a microprocessor coupled with the two-wire system powerline and configured to receive a control signal over the two-wire fire system powerline, to decode the received control signal, and to select either the fire alarm strobe or the mass notification strobe to emit light based upon the decoded control signal.

7. The system of claim 6, wherein the mass notification strobe comprises at least two light emitters that, when the mass notification strobe is selected, each emit a different color of light that mixes within the optical chamber to produce mixed light having an amber mass notification color that is a different color than the color emitted by each of the light emitters.

8. The system of claim 7, wherein the microprocessor outputs the decoded control signal as a strobe "on" command or as a strobe "off" command to a switch connected to select one of the fire alarm strobe or the mass notification strobe.

9. The system of claim 8, and further comprising:

a strobe charging circuit, a first capacitor connected to the fire alarm strobe; and a second capacitor connected to the mass notification strobe and positioned within the optical chamber, and wherein the switch is configured to distribute an electrical charge from the strobe charging circuit to one of the first capacitor or the second capacitor in response to the outputted decoded control signal.

10. The system of claim 7, wherein the optical chamber has a lens, and wherein the highly reflective surface is specular and/or diffuse, and is configured to reflect mixed light through the lens to form a mass notification pattern.

11. The system of claim 6, wherein the mass notification strobe is one of a single color-variable LED or an array of high-intensity Red, Green and Blue LED's.

* * * * *